US011773558B2

(12) United States Patent
Dai et al.

(10) Patent No.: US 11,773,558 B2
(45) Date of Patent: Oct. 3, 2023

(54) RAPID CONSTRUCTION DEVICE AND METHOD FOR PRESTRESSED BASALT FIBER ANCHOR ROD

(71) Applicant: Wuhan Center, China Geological Survey (Central South China Innovation Center for Geosciences), Wuhan (CN)

(72) Inventors: Zhenwei Dai, Wuhan (CN); Anle Zhang, Wuhan (CN); Shengtao Zhou, Wuhan (CN); Yanjun Zhang, Wuhan (CN); Xiaolin Fu, Wuhan (CN); Runqing Ye, Wuhan (CN); Jinjun Guo, Wuhan (CN); Zhigang Du, Wuhan (CN)

(73) Assignee: Wuhan Center, China Geological Survey (Central South China Innovation Center for Geosciences), Wuhan (CN)

( * ) Notice: Subject to any disclaimer, the term of this patent is extended or adjusted under 35 U.S.C. 154(b) by 79 days.

(21) Appl. No.: 17/584,442

(22) Filed: Jan. 26, 2022

(65) Prior Publication Data

US 2023/0151575 A1 May 18, 2023

(30) Foreign Application Priority Data

Nov. 15, 2021 (CN) ..... 202111345981.X

(51) Int. Cl.

| | |
|---|---|
| ***E02D 5/74*** | (2006.01) |
| ***E02D 5/38*** | (2006.01) |
| ***E02D 15/04*** | (2006.01) |

(52) U.S. Cl.
CPC ..... *E02D 5/74* (2013.01); *E02D 5/38* (2013.01); *E02D 15/04* (2013.01)

(58) Field of Classification Search
CPC ..... E02D 5/74; E02D 5/38; E02D 15/04
See application file for complete search history.

(56) References Cited

U.S. PATENT DOCUMENTS 3,464,216 A * 9/1969 Turzillo ..... E02D 15/04 405/242
3,665,717 A * 5/1972 Sweeney ..... E02D 5/76 405/259.5

(Continued)

FOREIGN PATENT DOCUMENTS

KR 101358994 B1 * 2/2014
KR 102028182 B1 * 11/2019
WO WO-2014007618 A2 * 1/2014 ..... E02D 5/80

*Primary Examiner* — Kyle Armstrong
(74) *Attorney, Agent, or Firm* — True Shepherd LLC; Andrew C. Cheng

(57) ABSTRACT

A rapid construction device for a prestressed basalt fiber anchor rod, includes a sleeve drill rod and a drill bit; the sleeve drill rod includes an inner and an outer cylinders; a middle of the drill bit is connected to a lower end of the inner cylinder, an edge of the drill is connected to a lower end of the outer cylinder, a constraint hole is defined in the middle of the drill bit for allowing a basalt fiber reinforced plastic (BFRP) penetrating therethrough, a magnetic baffle is arranged at a lower end of the constraint hole to shield the constraint hole, and a plurality of through holes are defined in the drill bit; and the BFRP is pushed to push off the magnetic baffle to lower the BFRP to a set position, and then a space between the inner and outer cylinders is grouted.

10 Claims, 10 Drawing Sheets

(56) References Cited

U.S. PATENT DOCUMENTS

| | | | | |
|---|---|---|---|---|
| 4,718,791 | A * | 1/1988 | Weatherby | E02D 5/74 405/262 |
| 10,486,330 | B2 | 11/2019 | Giles | |
| 10,688,683 | B2 | 6/2020 | Giles | |
| 2014/0345619 | A1 | 11/2014 | Holley et al. | |

* cited by examiner

RAPID CONSTRUCTION DEVICE AND METHOD FOR PRESTRESSED BASALT FIBER ANCHOR ROD

CROSS-REFERENCE TO RELATED APPLICATIONS

This application claims priority to Chinese Patent Application No. 202111345981.X with a filing date of Nov. 15, 2021. The content of the aforementioned application, including any intervening amendments thereto, is incorporated herein by reference.

TECHNICAL FIELD

The present disclosure relates to the technical field of geotechnical engineering anchoring, in particular to a rapid construction device and method for a prestressed basalt fiber anchor rod.

BACKGROUND ART

As one of the main supporting forms of slope engineering, the anchor rod can effectively prevent the structural deformation and maintain the structural stability. A rock-soil anchoring structure of a common steel anchor rod mostly has the durability problem caused by steel bar corrosion, which brings potential safety hazards to a supporting structure. The basalt fiber reinforced plastic (BFRP) with the advantages of high tensile strength, desirable corrosion resistance, desirable stability, convenience in material obtaining, etc. is a good substitute of steel bars in the anchoring technology. As the BFRP has the features of weak shear strength and high tensile strength in mechanical properties, it is difficult to directly anchor and tension the BFRP. At the present stage, the BFRP is generally connected to a steel strand and other metal bar materials through a steel casing pipe connector at the end of the BFRP, and epoxy resin is poured into the connector casing pipe to prepare the composite bar material. The manufacturing and construction process of the basalt fiber anchor rod is complex and needs high technological requirements, so the rapid construction requirement is difficult to meet.

SUMMARY

In view of this, for solving the problem that the manufacturing and construction process of the basalt fiber anchor rod is complex and needs high technological requirements, such that the rapid construction requirement is difficult to meet, the embodiment of the present disclosure provides a rapid construction device and method for a prestressed basalt fiber anchor rod.

Embodiments of the present disclosure provide a rapid construction device for a prestressed basalt fiber anchor rod, including a drilling, bar-penetrating and grouting assembly, the drilling, bar-penetrating and grouting assembly includes a sleeve drill rod and a drill bit;

the sleeve drill rod includes a drill rod inner cylinder and a drill rod outer cylinder arranged around the drill rod inner cylinder;

a middle part of the drill bit is connected to a lower end of the drill rod inner cylinder, an edge of the drill is connected to a lower end of the drill rod outer cylinder, a constraint hole is defined in the middle part of the drill bit so as to allow a basalt fiber reinforced plastic (BFRP) penetrating the drill rod inner cylinder to penetrate, a magnetic baffle is arranged at a lower end of the constraint hole to shield the constraint hole, and a plurality of through holes are defined in a portion, between the drill rod inner cylinder and the drill rod outer cylinder, of the drill bit; and the sleeve drill rod is configured to be connected to a drilling machine and driven by the drilling machine to drill and lift, during drilling to a set depth, the BFRP is pushed to push off the magnetic baffle to lower the BFRP to a set position, and during lifting, a space between the drill rod outer cylinder and the drill rod inner cylinder is grouted, and slurry falls below the drill bit via the through hole.

Further, a boss extending upwards is arranged in the middle part of the drill bit, and the constraint hole is a vertical via hole defined in the boss.

Further, a groove is defined in a position, located at the lower end of the constraint hole, of a lower portion of the boss so as to allow the magnetic baffle be embedded.

Further, the rapid construction device for a prestressed basalt fiber anchor rod includes an air blowing pump and a pressure pump, the air blowing pump is configured to blow air between the drill rod outer cylinder and the drill rod inner cylinder when the sleeve drill rod drills, and the pressure pump is used for grouting between the drill rod outer cylinder and the drill rod inner cylinder when the sleeve drill rod lifts.

Further, the rapid construction device for a prestressed basalt fiber anchor rod includes a prestress applying assembly which includes a leveling base plate supported at an opening of an anchor hole, a center hole jack arranged on the leveling base plate and a hydraulic extendable clamp arranged on the center hole jack, an upper end of the BFRP with the lower end anchored sequentially penetrates the center hole jack and the hydraulic extendable clamp, the hydraulic extendable clamp is configured to clamp the BFRP, and the center hole jack is configured to apply prestress to the BFRP.

Further, the hydraulic extendable clamp includes two steel ring beams oppositely arranged one above the other and an outer wrapping layer mounted between the two steel ring beams, the outer wrapping layer including a steel layer, a basalt fiber layer and a nylon fiber layer which are arranged from outside to inside sequentially, an oil injection cavity is defined in the steel layer, an oil inlet is defined in an outer wall of the steel layer, and a surface of the nylon fiber layer is roughened.

Further, the leveling base plate includes a top plate and a plurality of support legs connected to a bottom of the top plate, each of the support legs including an upper support leg and a lower support leg, the lower support leg is fixed at the opening of the anchor hole, an adjustment hole is defined in a lower end of the upper support leg, and an upper end of the lower support leg is connected to the adjustment hole in a fastened manner via a fastener.

Further, the rapid construction device for a prestressed basalt fiber anchor rod includes a hole plug anchor sealing assembly which includes a grouting baffle arranged at the opening of the anchor hole and a slurry baffle arranged in the anchor hole and distanced from the opening of the anchor hole with a set value, the BFRP sequentially penetrates the slurry baffle and the grouting baffle from bottom to top, an edge of the slurry baffle makes sealed contact with a wall of the anchor hole, a grouting pipe penetrates the grouting baffle, and the grouting pipe is used for grouting between the grouting baffle and the slurry baffle to form a concrete hole plug for locking the upper end of the BFRP.

Further, an outer seal ring sleeves the edge of the slurry baffle so as to press the wall of the anchor hole for sealing; and a bar bundle hole is defined in a middle part of the slurry baffle, and an inner seal ring is embedded in the bar bundle hole so as to allow the BFRP to penetrate and press the BFRP for sealing.

Embodiments of the present disclosure also provides a rapid construction method for a prestressed basalt fiber anchor rod, using the rapid construction device for a prestressed basalt fiber anchor rod, and including:

S1. connecting a sleeve drill rod to a drilling machine, and driving the sleeve drill rod by the drilling machine to drill to a set depth to form an anchor hole;

S2. pushing a BFRP downwards to make a magnetic baffle fall off, and then lowering the BFRP to a set position; and S3. lifting the sleeve drill rod via rotation of the drilling machine, grouting a space between a drill rod outer cylinder and a drill rod inner cylinder, and making slurry fall below a drill bit via a through hole, so as to anchor a lower end of the BFRP via solidification of the slurry.

The technical solution defined in the embodiment of the present disclosure has the beneficial effects that in the rapid construction device and method for a prestressed basalt fiber anchor rod, a basalt fiber reinforced plastic (BFRP) is lowered in an anchor hole drilling process, the BFRP is lowered to a preset anchoring position, meanwhile, grouting is completed in a sleeve drill rod returning and lifting process, in the grouting process, the BFRP is constrained by a constraint hole to be kept at the preset position, drilling, bar-penetrating and grouting of an anchoring section are completed simultaneously, the defects that a traditional basalt fiber anchor rod construction process is complex and tedious can be overcome, construction may be completed rapidly and efficiently, guarantee is provided for safety of a supporting structure, and the construction efficiency of the basalt fiber anchor rod may be greatly improved.

In the figures: 1—sleeve drill rod, 101—drill rod outer cylinder, 102—drill rod inner cylinder, 2—drill bit, 201—polycrystalline diamond compact (PDC) drill bit wall, 201*a*—through hole, 202—via hole wall, 202*a*—boss, 202*b*—magnetic baffle, 203—metal cutting edge, 3—anchor hole, 4—basalt fiber reinforced plastic, 5—leveling base plate, 501—top plate, 502—support leg, 502*a*—upper support leg, 502*b*—lower support leg, 502*c*—adjustment bolt, 503—angle gauge, 504—expansion bolt, 6—center hole jack, 7—hydraulic extendable clamp, 701—steel ring beam, 701*a*—fixing screw rod, 702—steel layer, 702*a*—oil inlet, 703—basalt fiber layer, 704—nylon fiber layer, 8—slurry baffle, 801—outer seal ring, 802—bar bundle hole, 803—inner seal ring, 9—grouting baffle, 901—grouting pipe, 902—exhaust port, 10—anchoring section, and 11—concrete hole plug.

DETAILED DESCRIPTION OF THE EMBODIMENTS

In order to make the objective, technical solution and advantages of the present disclosure clearer, embodiments of the present disclosure will be further described in detail in conjunction with the accompanying drawings. The following describes a preferred one of a number of possible embodiments of the present disclosure, and is intended to provide a basic understanding of the present disclosure, but is not intended to identify key or critical elements of the present disclosure or to define the scope of protection.

In the description of the present disclosure, it should be noted that, unless otherwise clearly specified, meanings of terms "mount" and "connect" should be understood in a board sense. For example, the connection may be a fixed connection, a detachable connection, or an integral connection; may be a mechanical connection or an electrical connection; may be a direct connection or an indirect connection by using an intermediate medium; or may be intercommunication between two components. Those of ordinary skill in the art may understand specific meanings of the foregoing terms in the present disclosure based on a specific situation.

Figure 1:
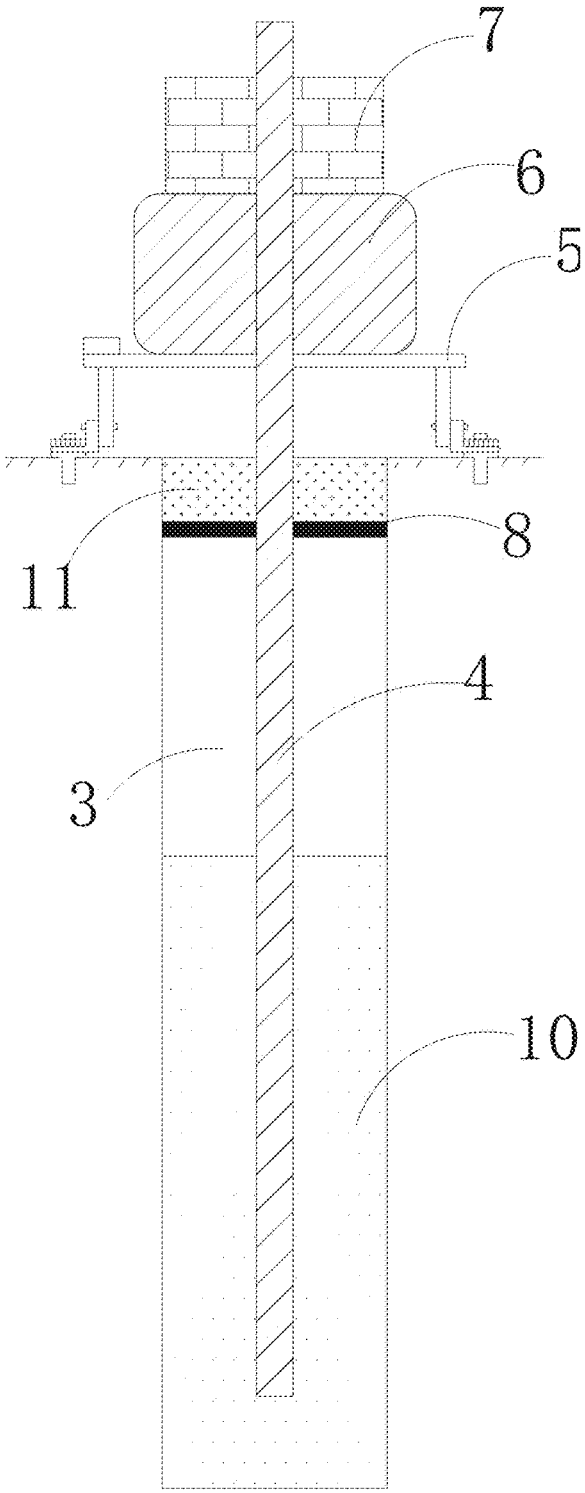
FIG. 1 is a schematic diagram of a rapid construction device for a prestressed basalt fiber anchor rod in the present disclosure.
Figure 2:
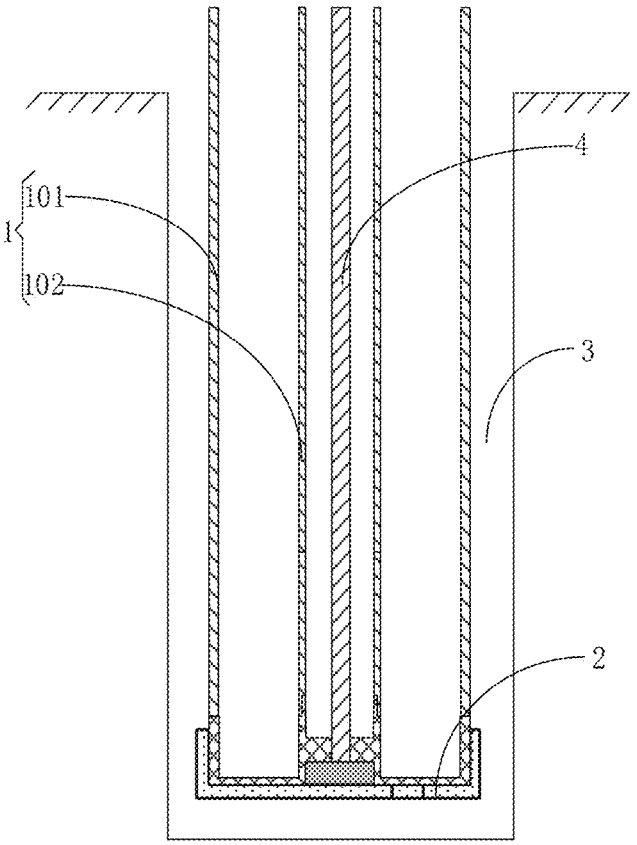
FIG. 2 is a structural schematic diagram of a drilling, bar-penetrating and grouting assembly.

With reference to FIGS. 1 and 2, the embodiment of the present disclosure provides a rapid construction device for a prestressed basalt fiber anchor rod. The device includes a drilling, bar-penetrating and grouting assembly, a prestress applying assembly and a hole plug anchor sealing assembly.

Figure 5:
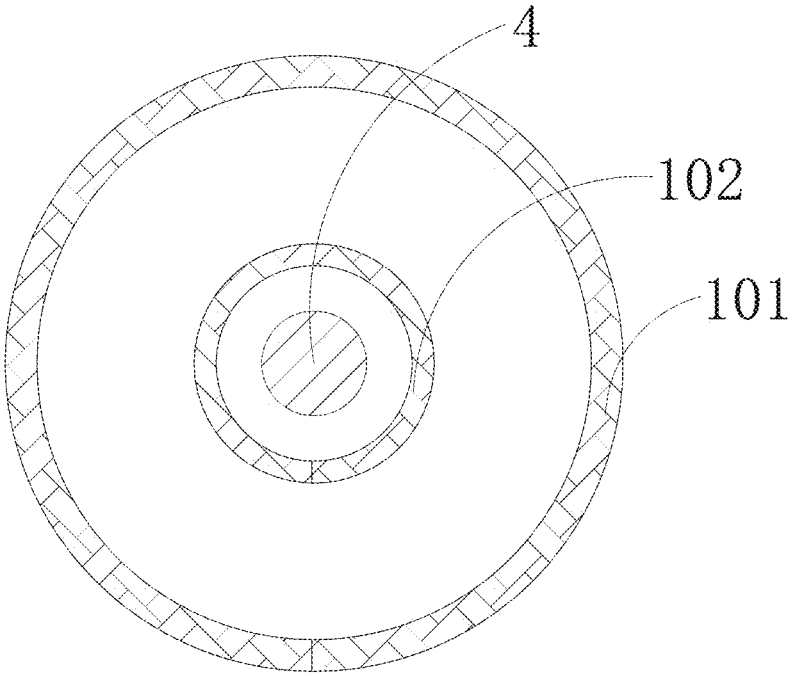
FIG. 5 is a sectional view of a sleeve drill rod 1 in FIG. 2.

As shown in FIGS. 2 and 5, the drilling, bar-penetrating and grouting assembly includes a sleeve drill rod 1 and a drill bit 2. Specifically, the sleeve drill rod 1 includes a drill rod inner cylinder 102 and a drill rod outer cylinder 101 arranged around the drill rod inner cylinder 102. The drill rod outer cylinder 101 and the drill rod inner cylinder 102 are both cylindrical and have coinciding axes, and threaded connectors are arranged at lower ends of the drill rod outer cylinder 101 and the drill rod inner cylinder 102.

Figure 3:
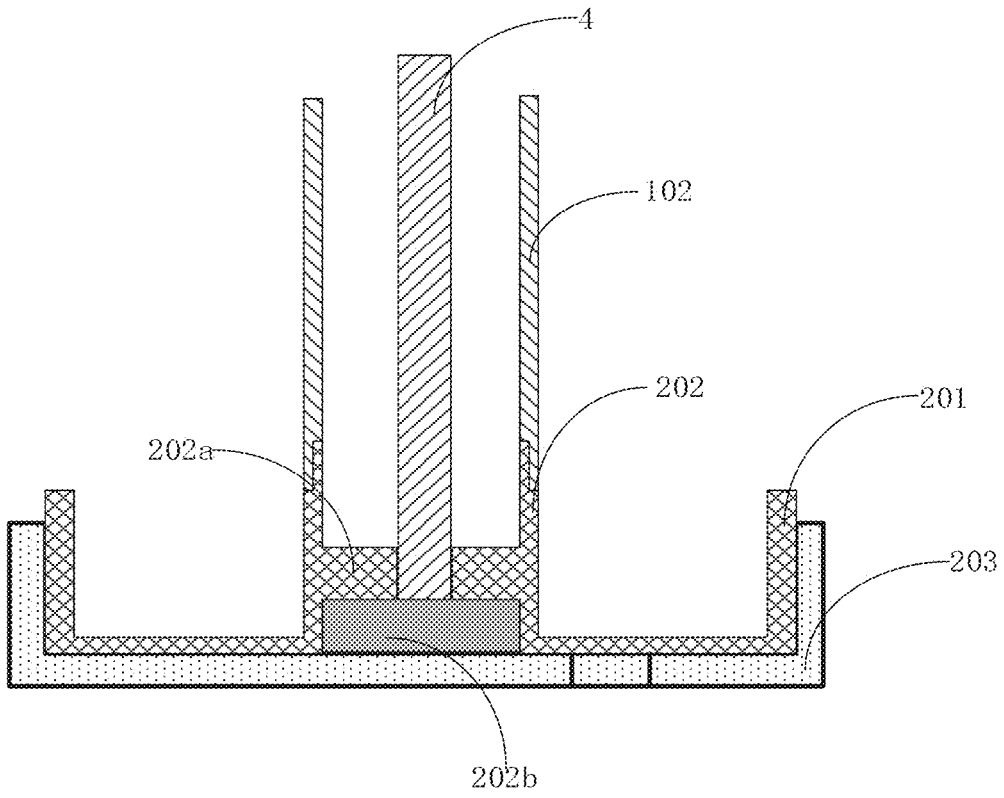
FIG. 3 is a structural schematic diagram of a drill bit 2 in FIG. 2.

As shown in FIGS. 2 and 3, a middle part of the drill bit 2 is connected to the lower end of the drill rod inner cylinder 102, and an edge of the drill bit 2 is connected to the lower end of the drill rod outer cylinder 101. Specifically, the drill bit 2 is a polycrystalline diamond compact (PDC) drill bit, including a PDC drill bit wall 201, a via hole wall 202 arranged in a middle part of the PDC drill bit wall 201, and a plurality of convex metal cutting edges 203 arranged at a bottom of the PDC drill bit wall 201. An edge of the PDC drill bit wall 201 is provided with a threaded connector and is connected to the threaded connector at the lower end of the drill rod outer cylinder 101 via the threaded connector. An upper end of the via hole wall 202 is provided with a threaded connector and is connected to the threaded connector at the lower end of the drill rod inner cylinder 102 via the threaded connector. In this way, the sleeve drill rod 1 is connected to the drill bit 2.

As shown in FIGS. 2 and 3, a constraint hole is defined in the middle part of the drill bit 2 so as to allow a basalt fiber reinforced plastic (BFRP) 4 penetrating the drill rod inner cylinder 102 to penetrate. The constraint hole is defined in an axis of the via hole wall 202 and penetrates the via hole wall 202. The BFRP 4 penetrating into the constraint hole is constrained by the constraint hole and kept on the axis of the drill rod inner cylinder 102.

In addition, a magnetic baffle 202*b* is arranged at a lower end of the constraint hole to shield the constraint hole, and the magnetic baffle 202*b* is used for blocking the lower end of the constraint hole so as to prevent the BFRP 4 from falling into the bottom of the hole in a drilling process, and further to prevent drilling cuttings from entering the drill rod inner cylinder 102. In this embodiment, a boss 202*a* extending upwards is arranged in the middle part of the drill bit 2, the boss 202*a* is located at a lower end of the via hole wall 202, and the constraint hole is a vertical via hole defined in the boss 202*a*. A groove is defined in a position, located at the lower end of the constraint hole, of a lower portion of the boss 202*a* so as to allow the magnetic baffle 202*b* to be embedded, and the magnetic baffle 202*b* abuts against the lower end of the BFRP 4 penetrating the constraint hole.

Figure 4:
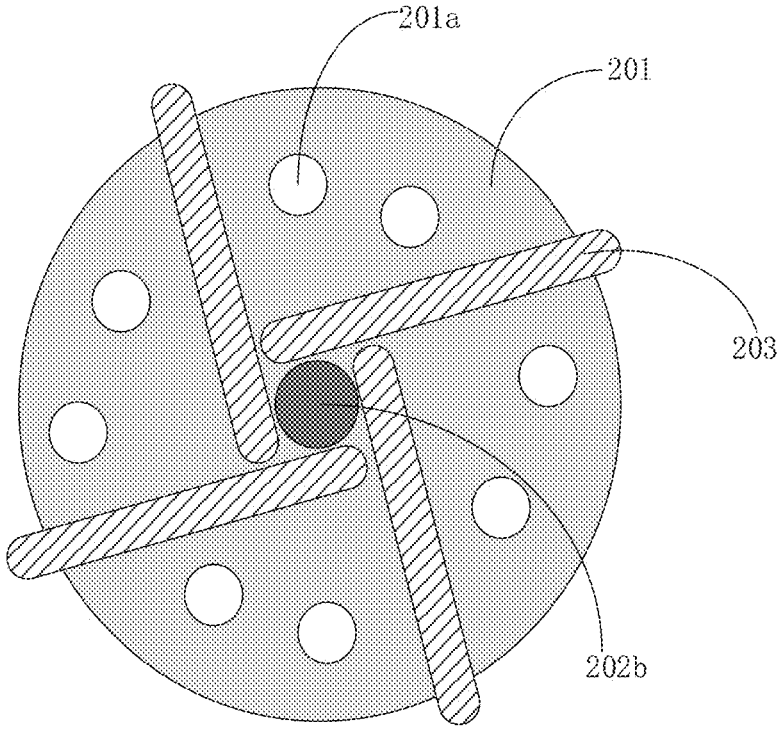
FIG. 4 is a bottom view of the drill bit 2 in FIG. 2.

As shown in FIG. 4, a plurality of through holes 201*a* are defined in a portion, between the drill rod inner cylinder 102 and the drill rod outer cylinder 101, of the drill bit 2. The through holes 201*a* are provided at the bottom of the PDC drill bit wall 201, in particular evenly distributed between the metal cutting edges 203. The through hole 201*a* is in communication with a space above and below the drill bit 2, such that airflow or slurry may flow from above to below the drill bit.

The drilling, bar-penetrating and grouting assembly further includes an air blowing pump and a pressure pump. The drilling, bar-penetrating and grouting assembly is used for drilling, bar-penetrating and grouting. Specifically, the sleeve drill rod 1 is connected to a drilling machine and driven by the drilling machine to drill and lift. During drilling, the sleeve drill rod 1 drills to a set depth to form an anchor hole, in the drilling process, air is blown between the drill rod outer cylinder 101 and the drill rod inner cylinder 102 via the air blowing pump, the airflow is blown out from the through hole, and drilling cuttings are blown out. During bar penetrating, the BFRP 4 is pushed to push off the magnetic baffle 202*b*, such that the BFRP 4 is lowered to a set position. During grouting, the sleeve drill rod 1 is lifted via rotation of the drilling machine, a space between the drill rod outer cylinder 101 and the drill rod inner cylinder 102 is grouted by using the pressure pump, and slurry falls below the drill bit 2 via the through hole 201*a*, so as to anchor the lower end of the BFRP 4 via solidification of the slurry.

Figure 6:
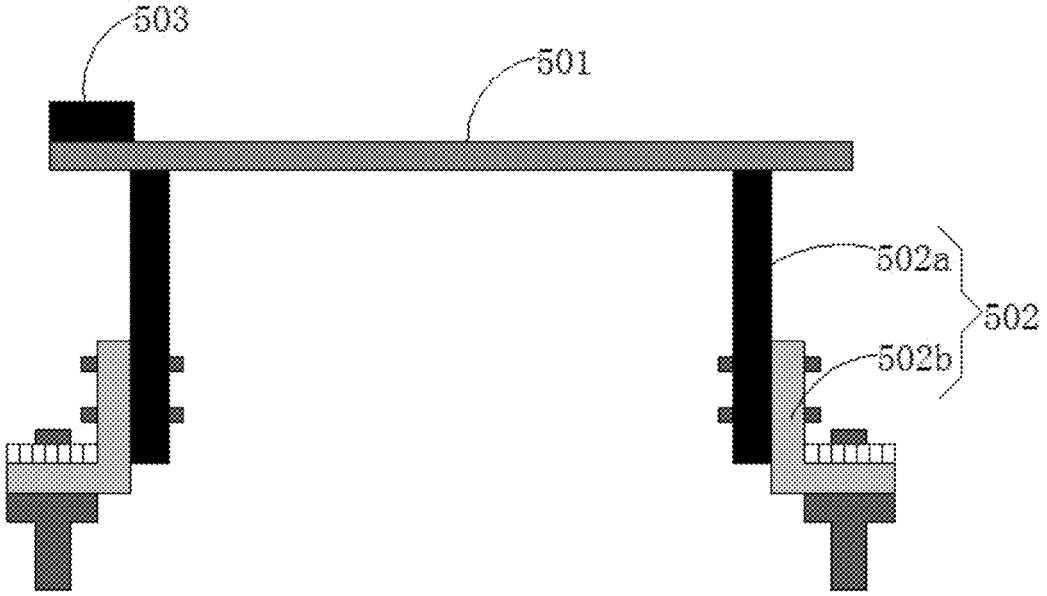
FIG. 6 is a structural schematic diagram a leveling base plate 5 in FIG. 1.

As shown in FIGS. 1 and 6, the prestress applying assembly includes a leveling base plate 5 supported at an opening of the anchor hole, a center hole jack 6 arranged on the leveling base plate 5 and a hydraulic extendable clamp 7 arranged on the center hole jack 6. An upper end of the BFRP 4 with the lower end anchored sequentially penetrates the center hole jack 6 and the hydraulic extendable clamp 7, the hydraulic extendable clamp 7 is configured to clamp the BFRP 4, and the center hole jack 6 is configured to apply prestress to the BFRP 4.

As shown in FIG. 6, the leveling base plate 5 includes a top plate 501 and a plurality of support legs 502 connected to a bottom of the top plate 501, each of the support legs 502 including an upper support leg 502*a* and a lower support leg 502*b*, the lower support leg 502*b* is fixed at the opening of the anchor hole 3, an adjustment hole is defined in a lower end of the upper support leg 502*a*, and an upper end of the lower support leg 502*b* is connected to the adjustment hole in a fastened manner via a fastener.

Specifically, the lower support leg 502*b* is fixed to the opening of the anchor hole 3 via an expansion bolt 504, the expansion bolt 504 being mounted to an earth surface where the opening of the anchor hole 3 is located. The lower support leg 502*b* is L-shaped and is connected to the expansion bolt 504 in a fastened manner.

Figure 7:
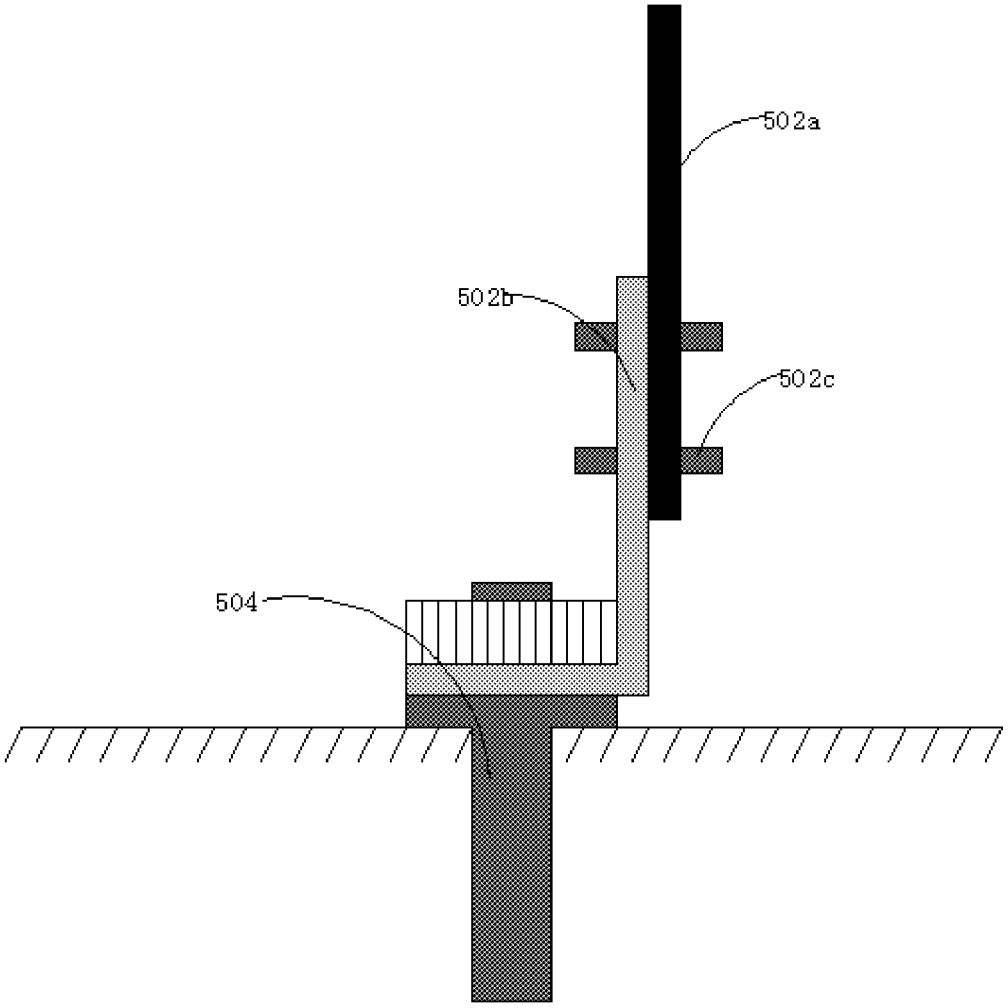
FIG. 7 is a structural schematic diagram of a support leg 502 in FIG. 6.

As shown in FIG. 7, the fastener is an adjustment bolt 502*c*, and there may be a plurality of fasteners, and the plurality of adjustment bolts 502*c* penetrate the upper end of the lower support leg 502*b* and the adjustment hole to connect the upper support leg 502*a* to the lower support leg 502*b* in a fastened manner. The adjustment hole may slide up and down to a proper mounting position and then is fastened in the fastening process of the adjustment bolt 502*c*, so as to adjust a height of each of the support legs 502, and the top plate 501 is perpendicular to an axis direction of the BFRP 4. In addition, an angle gauge 503 may be arranged on the top plate 501 to match the support leg 502 for leveling, and it may be guaranteed that when the opening of the anchor hole 3 is uneven, the top plate 501 is leveled to be perpendicular to the axis direction of the BFRP 4.

Figure 8:
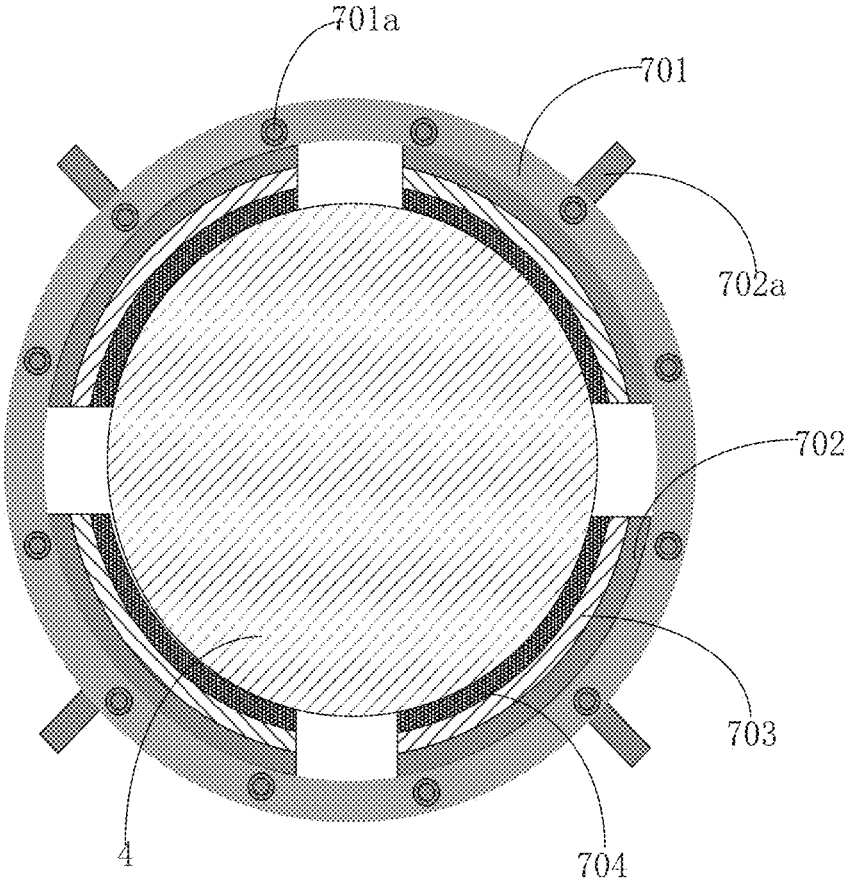
FIG. 8 is a structural schematic diagram of a hydraulic extendable clamp 7 in FIG. 1.

As shown in FIGS. 1 and 8, the hydraulic extendable clamp 7 is fixed to the center hole jack 6 and includes two steel ring beams 701 oppositely arranged one above the other and an outer wrapping layer mounted between the two steel ring beams 701, the outer wrapping layer including a steel layer 702, a basalt fiber layer 703 and a nylon fiber layer 704 which are arranged from outside to inside sequentially, an oil injection cavity is defined in the steel layer 702, an oil inlet 702*a* is defined in an outer wall of the steel layer 702.

An upper top face and a lower top face of the steel layer 702 are provided with a plurality of sets of inwards-concave threaded concave holes, the steel ring beam 701 is provided with a plurality of via holes, the via holes correspond one-to-one to the threaded concave holes, and fixing screw rods 701*a* penetrate the via holes respectively so as to connect the via holes to the corresponding threaded concave holes. In this way, an upper end and a lower end of the steel layer 702 are fixedly connected to the two steel ring beams 701 respectively. The steel layer 702 may only press the BFRP 4 inwards under the action of oil pressure, and an inner surface of the nylon fiber layer 704 needs to be roughened to increase static friction between the nylon fiber layer 704 and the BFRP 4.

Figure 9:
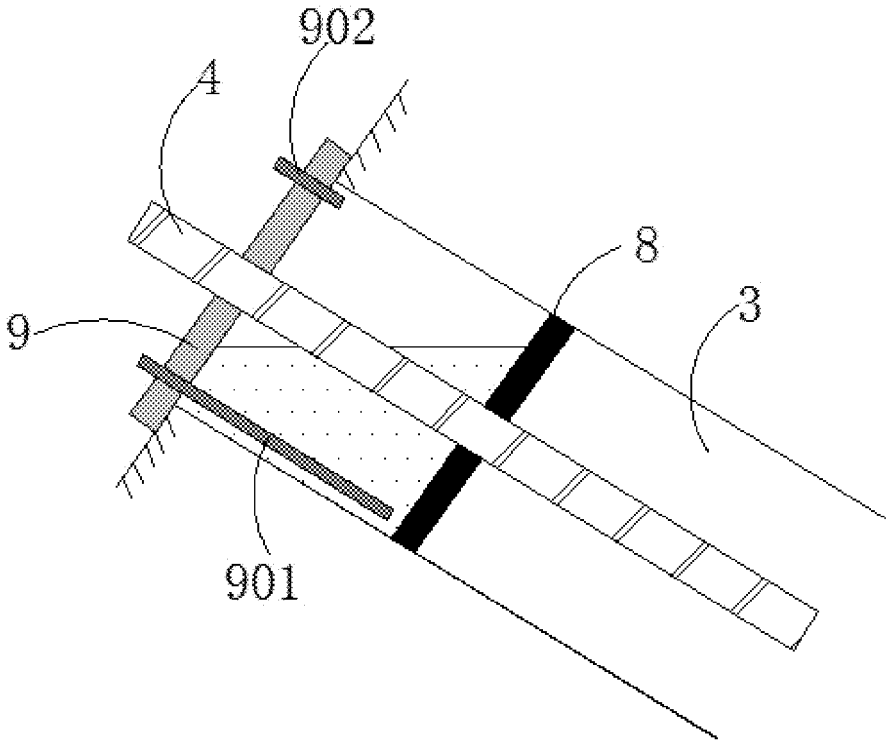
FIG. 9 is a structural schematic diagram of a hole plug anchor sealing assembly.

As shown in FIGS. 1 and 9, a hole plug anchor sealing assembly includes a grouting baffle 9 arranged at the opening of the anchor hole 3 and a slurry baffle 8 arranged in the anchor hole 3 and distanced from the opening of the anchor hole 3 with a set value, the BFRP 4 sequentially penetrates the slurry baffle 8 and the grouting baffle 9 from bottom to top, an edge of the slurry baffle 8 makes sealed contact with a wall of the anchor hole 3, and a grouting pipe 901 and an exhaust port 902 penetrate the grouting baffle 9.

Figure 10:
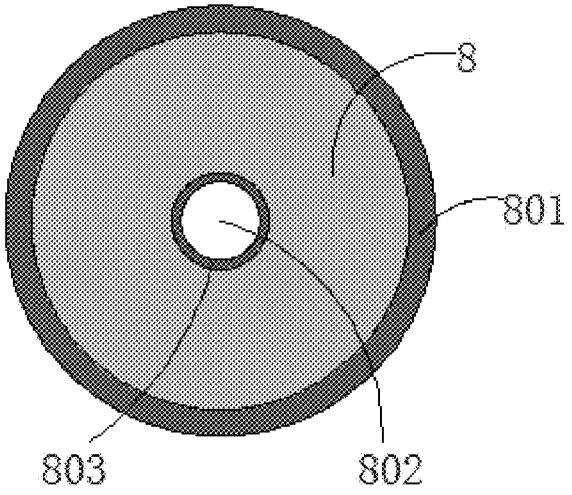
FIG. 10 is a structural schematic diagram of a slurry baffle 8 in FIG. 1.

As shown in FIG. 10, an outer seal ring 801 sleeves the edge of the slurry baffle 8 so as to press the wall of the anchor hole 3 for sealing; and a bar bundle hole 802 is defined in a middle part of the slurry baffle 8, and an inner seal ring 803 is embedded in the bar bundle hole 802 so as to allow the BFRP 4 to penetrate and press the BFRP 4 for sealing.

After the center hole jack 6 applies the prestress to the BFRP 4, the grouting pipe 901 is used for grouting between the grouting baffle 9 and the slurry baffle 8 to form a concrete hole plug 11 for locking the upper end of the BFRP 4.

In addition, as shown in FIGS. 1-10, based on the rapid construction device for a prestressed basalt fiber anchor rod, the embodiment of the present disclosure further provides a rapid construction method for a prestressed basalt fiber anchor rod. The method includes:

S1. connect a sleeve drill rod 1 to a drilling machine, drive the sleeve drill rod 1 by the drilling machine to drill to a set depth to form an anchor hole 3, and blow air between a drill rod outer cylinder 101 and a drill rod inner cylinder 102 via an air blowing pump in a drilling process, so as to blow drilling cuttings out of a gap between the drill rod outer cylinder 101 and the anchor hole 3;

S2. push a BFRP 4 downwards to make a magnetic baffle 202*b* fall off, and then lowering the BFRP 4 to a set position; and S3. lift the sleeve drill rod 1 via rotation of the drilling machine, grout a space between the drill rod outer cylinder 101 and the drill rod inner cylinder 102 via a pressure pump, and make slurry fall below a drill bit 2 via a through hole 201*a*, so as to anchor a lower end of the BFRP 4 via solidification of the grout to form an anchoring section 10. In a lifting process of the sleeve drill rod 1, the BFRP 4 is constrained by a constraint hole to be kept at a set position, so as to anchor the BFRP 4 at the preset position.

Then slurry for an anchoring section 10 is maintained, after the slurry is solidified to reach designed strength, the BFRP 4 sequentially penetrates a slurry baffle 8 and a grouting baffle 9 from bottom to top, and the slurry baffle 8 and the grouting baffle 9 are mount at designed positions respectively. Then, a leveling base plate 5 is mounted at an opening of the anchor hole 3, a center hole jack 6 and a hydraulic extendable clamp 7 are mounted on an upper portion of the leveling base plate 5 sequentially, and the BFRP 4 penetrates the center hole jack 6 and the hydraulic extendable clamp 7 sequentially.

The BFRP 4 is then pre-stressed: a confining pressure value of the hydraulic extendable clamp 7 is set according to a design value of tensile strength of the basalt fiber anchor rod and a peripheral area of the BFRP 4, and the oil inlet amount of an oil inlet is adjusted to make the hydraulic extendable clamp 7 tightly hold the gripped BFRP. The center hole jack 6 is opened to integrally tension the BFRP 4. When the BFRP 4 is tensioned to a designed prestress value, the center hole jack 6 is locked.

Finally, anchor sealing treatment is performed on the BFRP 4: early-strength micro-expansion concrete slurry is injected into a space between the slurry baffle 8 and the grouting baffle 9 via a grouting pipe 901, and grouting is stopped until the injected early-strength micro-expansion concrete slurry overflows from an exhaust port 902. After the strength of the early-strength micro-expansion concrete reaches lockable strength, the center hole jack 6 and the hydraulic extendable clamp 7 are closed, and the hydraulic extendable clamp 7, the center hole jack 6, the leveling base plate 5 and the grouting baffle 9 are sequentially taken down. The BFRP is cut along an upper surface of a concrete hole plug 11, such that simple and rapid anchor sealing treatment is achieved.

Herein, the involved orientation terms such as "front", "rear", "upper", and "lower" are defined in terms of the positions of parts and between the parts in the drawings, which are used just for clarity and convenience of expressing the technical solution. It should be understood that they are relative concepts and may vary accordingly according to different ways of use and placement, and the use of such parties should not limit the scope of protection of the claimed application.

The above examples and the features in the examples herein may be combined with each other in a non-conflicting situation.

The above descriptions are merely preferred examples of the present disclosure, and are not intended to limit the present disclosure. Any modifications, equivalent replacements, improvements, and the like made within the spirit and principle of the present disclosure shall be all included in the protection scope of the present disclosure.

What is claimed is:

1. A rapid construction device for a prestressed basalt fiber anchor rod, comprising a drilling, bar-penetrating and grouting assembly, wherein the drilling, bar-penetrating and grouting assembly comprises a sleeve drill rod and a drill bit;

the sleeve drill rod comprises a drill rod inner cylinder and a drill rod outer cylinder arranged around the drill rod inner cylinder;

a middle part of the drill bit is connected to a lower end of the drill rod inner cylinder, an edge of the drill is connected to a lower end of the drill rod outer cylinder, a constraint hole is defined in the middle part of the drill bit so as to allow a basalt fiber reinforced plastic (BFRP) penetrating the drill rod inner cylinder to penetrate, a magnetic baffle is arranged at a lower end of the constraint hole to shield the constraint hole, and a plurality of through holes are defined in a portion, between the drill rod inner cylinder and the drill rod outer cylinder, of the drill bit; and the sleeve drill rod is configured to be connected to a drilling machine and driven by the drilling machine to drill and lift, during drilling to a set depth, the BFRP is pushed to push off the magnetic baffle to lower the BFRP to a set position, and during lifting, a space between the drill rod outer cylinder and the drill rod inner cylinder is grouted, and slurry falls below the drill bit via the through hole.

2. The device according to claim 1, wherein a boss extending upwards is arranged in the middle part of the drill bit, and the constraint hole is a vertical via hole defined in the boss.

3. The device according to claim 2, wherein a groove is defined in a position, located at the lower end of the constraint hole, of a lower portion of the boss so as to allow the magnetic baffle be embedded.

4. The device according to claim 1, further comprising an air blowing pump and a pressure pump, wherein the air blowing pump is configured to blow air between the drill rod outer cylinder and the drill rod inner cylinder when the sleeve drill rod drills, and the pressure pump is used for grouting between the drill rod outer cylinder and the drill rod inner cylinder when the sleeve drill rod lifts.

5. The device according to claim 1, further comprising a prestress applying assembly which comprises a leveling base plate supported at an opening of an anchor hole, a center hole jack arranged on the leveling base plate and a hydraulic extendable clamp arranged on the center hole jack, wherein an upper end of the BFRP with the lower end anchored sequentially penetrates the center hole jack and the hydraulic extendable clamp, the hydraulic extendable clamp is configured to clamp the BFRP, and the center hole jack is configured to apply prestress to the BFRP.

6. The device according to claim 5, wherein the hydraulic extendable clamp comprises two steel ring beams oppositely arranged one above the other and an outer wrapping layer mounted between the two steel ring beams, the outer wrapping layer comprising a steel layer, a basalt fiber layer and a nylon fiber layer which are arranged from outside to inside sequentially, an oil injection cavity is defined in the steel layer, an oil inlet is defined in an outer wall of the steel layer, and a surface of the nylon fiber layer is roughened.

7. The device according to claim 5, wherein the leveling base plate comprises a top plate and a plurality of support legs connected to a bottom of the top plate, each of the support legs comprises an upper support leg and a lower support leg, the lower support leg is fixed at the opening of the anchor hole, an adjustment hole is defined in a lower end of the upper support leg, and an upper end of the lower support leg is connected to the adjustment hole in a fastened manner via a fastener.

8. The device according to claim 1, further comprising a hole plug anchor sealing assembly which comprises a grouting baffle arranged at the opening of the anchor hole and a slurry baffle arranged in the anchor hole and distanced from the opening of the anchor hole with a set value, the BFRP sequentially penetrates the slurry baffle and the grouting baffle from bottom to top, an edge of the slurry baffle makes sealed contact with a wall of the anchor hole, a grouting pipe penetrates the grouting baffle, and the grouting pipe is used for grouting between the grouting baffle and the slurry baffle to form a concrete hole plug for locking the upper end of the BFRP.

9. The device according to claim 8, wherein an outer seal ring sleeves the edge of the slurry baffle so as to press the wall of the anchor hole for sealing; and a bar bundle hole is defined in a middle part of the slurry baffle, and an inner seal ring is embedded in the bar bundle hole so as to allow the BFRP to penetrate and press the BFRP for sealing.

10. A rapid construction method for a prestressed basalt fiber anchor rod, using the rapid construction device for a prestressed basalt fiber anchor rod according to claim 1, and comprising:

S1. connecting a sleeve drill rod to a drilling machine, and driving the sleeve drill rod by the drilling machine to drill to a set depth to form an anchor hole;

S2. pushing a BFRP downwards to make a magnetic baffle fall off, and then lowering the BFRP to a set position; and S3. lifting the sleeve drill rod via rotation of the drilling machine, grouting a space between a drill rod outer cylinder and a drill rod inner cylinder, and making slurry fall below a drill bit via a through hole, so as to anchor a lower end of the BFRP via solidification of the slurry.

* * * * *